US012213588B2

(12) United States Patent
Peng et al.

(10) Patent No.: US 12,213,588 B2
(45) Date of Patent: Feb. 4, 2025

(54) WINE CABINET

(71) Applicant: HISENSE RONSHEN (GUANGDONG) REFRIGERATOR CO., LTD., Guangdong (CN)

(72) Inventors: Xiaoshun Peng, Guangdong (CN); Minwei Tan, Guangdong (CN)

(73) Assignee: HISENSE RONSHEN (GUANGDONG) REFRIGERATOR CO., LTD., Foshan (CN)

( * ) Notice: Subject to any disclaimer, the term of this patent is extended or adjusted under 35 U.S.C. 154(b) by 138 days.

(21) Appl. No.: 18/114,893

(22) Filed: Feb. 27, 2023

(65) Prior Publication Data

US 2023/0200532 A1 Jun. 29, 2023

Related U.S. Application Data

(63) Continuation of application No. PCT/CN2021/121616, filed on Sep. 29, 2021.

(51) Int. Cl.
*A47B 88/50* (2017.01)
*A47B 46/00* (2006.01)
(Continued)

(52) U.S. Cl.
CPC ..... *A47B 88/50* (2017.01); *A47B 46/00* (2013.01); *A47B 69/00* (2013.01); *A47B 88/483* (2017.01); *F25D 17/06* (2013.01)

(58) Field of Classification Search
CPC ..... A47B 88/50; A47B 88/483; A47B 88/919; A47B 88/40; A47B 88/427; A47B 88/443;
(Continued)

(56) References Cited

U.S. PATENT DOCUMENTS 7,210,659 B2 * 5/2007 Lawson ..... D06F 95/004 211/94.01
8,382,218 B2 * 2/2013 Placke ..... F25D 25/025 312/334.7
(Continued)

FOREIGN PATENT DOCUMENTS

CN 202350430 U 7/2012
CN 202714493 U 2/2013
(Continued)

OTHER PUBLICATIONS

International Search Report and Written Opinion dated Dec. 22, 2021 in corresponding International Application No. PCT/CN2021/121616, translated, 20 pages.
(Continued)

*Primary Examiner* — Janet M Wilkens
(74) *Attorney, Agent, or Firm* — MH2 TECHNOLOGY LAW GROUP LLP

(57) ABSTRACT

A wine cabinet includes a cabinet body, a cabinet door, at least one slide rail, at least one shelf, and a protective cover. The cabinet body is provided with a storage compartment. The at least one slide rail is disposed in the storage compartment. The slide rail includes a first slide sub-rail and a second slide sub-rail. The first slide sub-rail is disposed on the cabinet body. The second slide sub-rail is slidable with respect to the first slide sub-rail. The second slide sub-rail includes a main body and at least one fixing member. The at least one shelf is detachably connected with the fixing member, so as to slide along with the second slide sub-rail. The protective cover is detachably disposed at a connecting position between the shelf and the slide rail.

18 Claims, 6 Drawing Sheets

(51) Int. Cl.
*A47B 69/00* (2006.01)
*A47B 88/483* (2017.01)
*F25D 17/06* (2006.01)

(58) Field of Classification Search
CPC ..... A47B 88/90; A47B 46/00; A47B 73/00; A47B 47/00; A47B 97/00; A47B 2088/401; A47B 2210/01; A47B 2210/04; F25D 17/06; F25D 25/024; F25D 25/025; F25D 25/022
USPC ..... 312/334.1, 334.7, 334.8, 404; 211/46, 211/94.01
See application file for complete search history.

(56) References Cited

U.S. PATENT DOCUMENTS

| | | | | |
|---|---|---|---|---|
| 9,743,765 | B2 * | 8/2017 | Lawson | A47B 88/40 |
| 2005/0122017 | A1 | 6/2005 | Son | |
| 2008/0231155 | A1 * | 9/2008 | Shen | A47B 88/994 312/334.1 |
| 2012/0146476 | A1 * | 6/2012 | Tibbe | A47B 77/18 384/22 |
| 2012/0248955 | A1 * | 10/2012 | Rehage | F24C 15/168 312/334.1 |
| 2013/0264928 | A1 * | 10/2013 | Hong | F25D 25/025 312/404 |

FOREIGN PATENT DOCUMENTS

| | | | | |
|---|---|---|---|---|
| CN | 103549774 | A | 2/2014 | |
| CN | 103622336 | A | 3/2014 | |
| CN | 105387678 | A | 3/2016 | |
| CN | 208403701 | U | 1/2019 | |
| CN | 208403705 | U | 1/2019 | |
| CN | 109452783 | A | 3/2019 | |
| CN | 208597889 | U | 3/2019 | |
| CN | 208988051 | U | 6/2019 | |
| CN | 209090331 | U | 7/2019 | |
| CN | 210446214 | U | 5/2020 | |
| CN | 210672659 | U | 6/2020 | |
| CN | 211408182 | U | 9/2020 | |
| CN | 112190027 | A | 1/2021 | |
| DE | 202005016305 | U1 * | 10/2006 | A47B 77/18 |
| DE | 102017106104 | A1 * | 9/2018 | F24C 15/168 |
| EP | 4397912 | A1 * | 7/2024 | F24C 15/168 |
| WO | WO-2009079670 | A1 * | 7/2009 | A47B 88/457 |
| WO | WO-2022258335 | A1 * | 12/2022 | |

OTHER PUBLICATIONS

Chinese First Office Action dated Sep. 6, 2021 in corresponding Chinese Application No. 202011004686.3, translated, 20 pages.
Chinese Second Office Action dated Feb. 22, 2022 in corresponding Chinese Application No. 202011004686.3, translated, 18 pages.

* cited by examiner

WINE CABINET

CROSS-REFERENCE TO RELATED APPLICATIONS

This application is a continuation application of International Application No. PCT/CN2021/121616, filed on Sep. 29, 2021, which claims priority to Chinese Patent Application No. 202011004686.3, filed on Sep. 22, 2020, which are incorporated herein by reference in their entireties.

TECHNICAL FIELD

The present disclosure relates to the technological field of refrigeration appliances, and in particular, to a wine cabinet.

BACKGROUND

With the improvement of living standards, red wine is increasingly popular for consumers. A wine cabinet is used as a device for storing wine bottles and may provide the wine bottles with a storage environment having suitable temperature, so as to ensure the quality of wine in the wine bottles.

SUMMARY

A wine cabinet is provided. The wine cabinet includes a cabinet body, a cabinet door, at least one slide rail, at least one shelf, and a protective cover. The cabinet body is provided with a storage compartment. The cabinet door is disposed on the cabinet body, and is configured to open or close the storage compartment. The at least one slide rail is disposed in the storage compartment. The slide rail includes a first slide sub-rail and a second slide sub-rail. The first slide sub-rail is disposed on the cabinet body. The second slide sub-rail is slidable with respect to the first slide sub-rail. The second slide sub-rail includes a main body and at least one fixing member. The at least one fixing member is disposed on the main body. The at least one shelf is detachably connected with the fixing member, so as to slide along with the second slide sub-rail. The protective cover is detachably disposed at a connecting position between the shelf and the slide rail. A first portion of the protective cover is disposed on the fixing member and abuts against a portion of the shelf located in the fixing member, a second portion of the protective cover is disposed on a side of the fixing member away from the main body, and the second portion of the protective cover extends in a direction proximate to a bottom of the cabinet body and is inclined in a direction away from the slide rail.

BRIEF DESCRIPTION OF THE DRAWINGS

In order to describe the technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, but are not limitations on an actual size of a product, an actual process of a method and an actual timing of a signal involved in the embodiments of the present disclosure.

DETAILED DESCRIPTION

Figure 1:
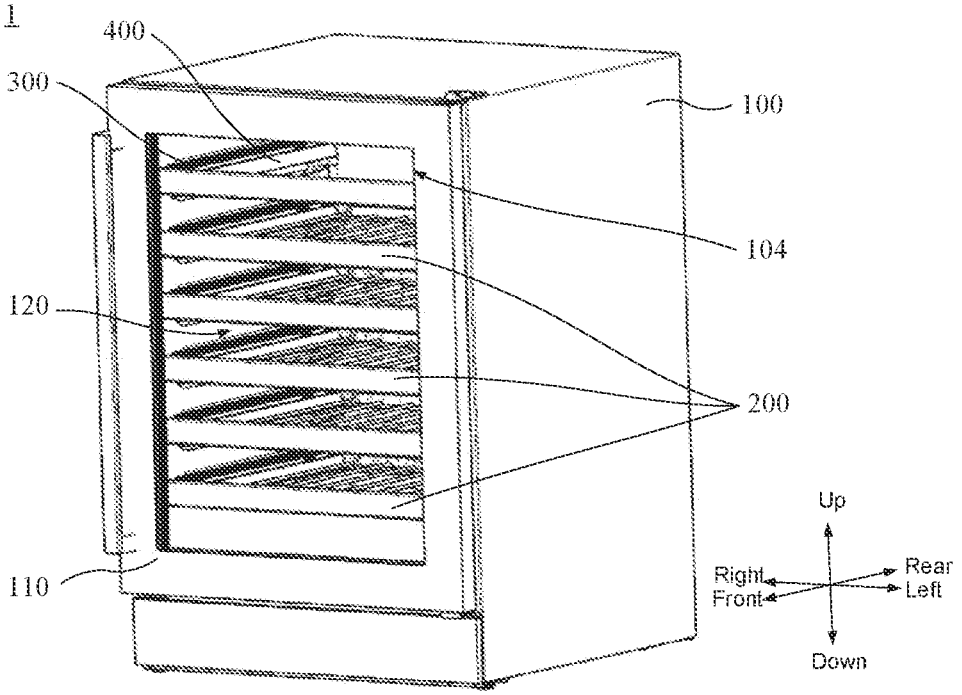
FIG. 1 is a diagram showing a structure of a wine cabinet, in accordance with some embodiments.

Some embodiments of the present disclosure will be clearly and completely described below with reference to the accompanying drawings. However, the described embodiments are merely some but not all embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment." "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Hereinafter, the terms such as "first" and "second" are only used for descriptive purposes and are not to be construed as indicating or implying the relative importance or implicitly indicating the number of indicated technical features. Therefore, the feature defined with the term such as "first" or "second" may explicitly or implicitly include one or more of the features. In the description of the embodiments of the present disclosure, the term "a plurality of" or "the plurality of" means two or more unless otherwise specified.

In the description of some embodiments, the term "connected" and derivatives thereof may be used. The term "connected" should be understood in a broad sense. For example, the term "connected" may represent a fixed connection, a detachable connection, or a one-piece connection, or may represent a direct connection, or may represent an indirect connection through an intermediate medium. The embodiments disclosed herein are not necessarily limited to the content herein.

The phrase "A and/or B" includes following three combinations: only A, only B, and a combination of A and B.

The use of the phrase "applicable to" or "configured to" herein means an open and inclusive expression, which does not exclude devices that are applicable to or configured to perform additional tasks or steps.

The term such as "about," "substantially." or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel," "perpendicular," or "equal" as used herein includes a stated condition and a condition similar to the stated condition. A range of the similar condition is within an acceptable deviation range, and the acceptable deviation range is determined by a person of ordinary skill in the art, considering measurement in question and the error associated with the measurement of a particular quantity (i.e., the limitation of a measurement system).

For ease of description, unless otherwise specified, the orientation expressions of up, down, left, right, front, and rear in the present disclosure each are referred to a state when the wine cabinet is used. When the wine cabinet is used, a side of the wine cabinet facing a user (i.e., a side of the wine cabinet facing the indoor) is a front side, and a side opposite thereto is a rear side. A height direction of the wine cabinet is an up-down direction. A left-right direction of the wine cabinet is opposite to a left-right direction of the user. For example, a left side of the wine cabinet is a right side of the user, and a right side of the wine cabinet is a left side of the user.

In the description of the present disclosure, it can be understood that, orientations or positional relationships indicated by the terms such as "central." "longitudinal," "crosswise," "length," "width," "thickness," "up," "down," "front," "rear," "left," "right," "vertical," "horizontal," "top." "bottom," "inner," "outer," "clockwise," "counterclockwise," and the like are based on orientations or positional relationships shown in the drawings, which are merely to facilitate and simplify the description of the present disclosure, and are not to indicate or imply that the devices or elements referred to must have a particular orientation, or must be constructed or operated in a particular orientation. Therefore, these terms should not be construed as limitations of the present disclosure.

For a wine cabinet with a push-pull structure, a shelf is typically fixedly connected to the push-pull structure in the wine cabinet through bolts. However, during transportation of the wine cabinet, the shelf disposed on the push-pull structure is easy to slide, which causes the collision between the shelf and the wine cabinet, thereby causing damage to the wine cabinet. Generally, in order to avoid the collision between the shelf and the wine cabinet during the transportation of the wine cabinet, the shelf may be detachably connected to the push-pull structure, so that the shelf may be separated from the wine cabinet during the transportation of the wine cabinet. However, this may easily result in an unstable connection between the shelf and the push-pull structure, and the shelf may be easily disengaged from the push-pull structure. Moreover, a wine bottle on the shelf is also easily scratched by the push-pull structure, or the connecting position between the shelf and the push-pull structure.

In order to solve the above problem, some embodiments of the present disclosure provide a wine cabinet 1.

Figure 2:
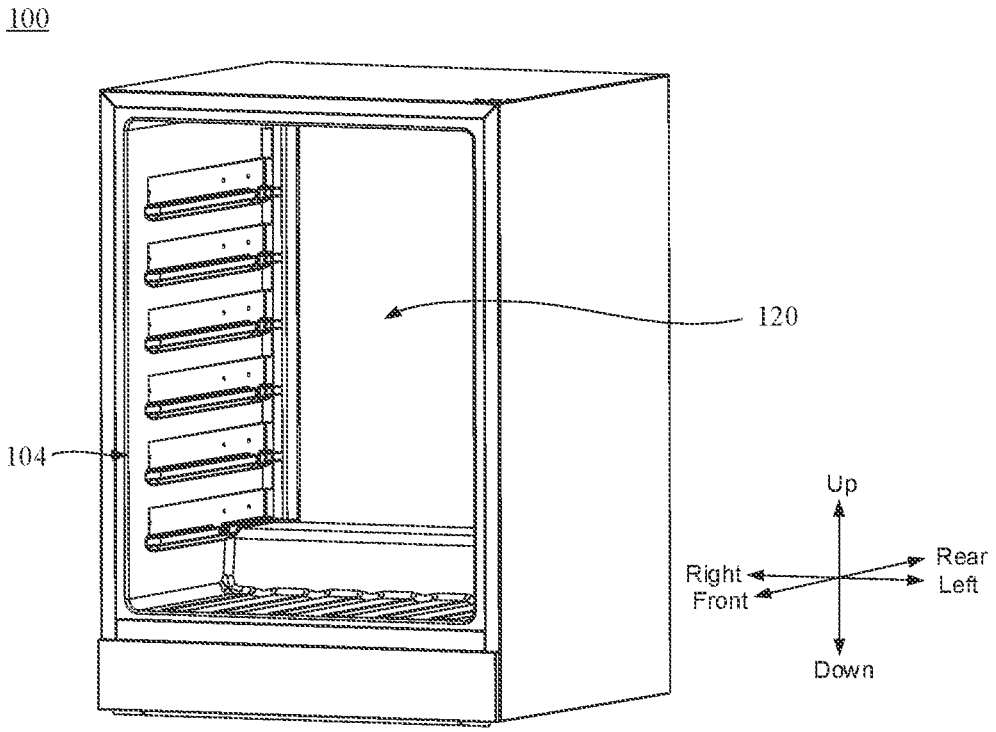
FIG. 2 is a diagram showing a structure of a cabinet body in a wine cabinet, in accordance with some embodiments.
Figure 3:
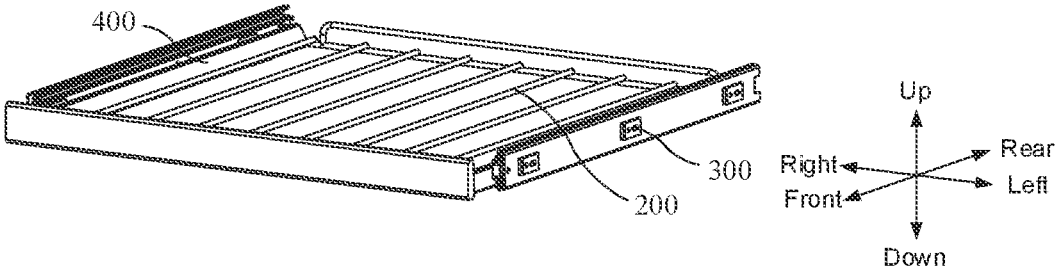
FIG. 3 is a diagram showing a structure of a shelf, a slide rail and a protective cover in a wine cabinet, in accordance with some embodiments.
Figure 4:
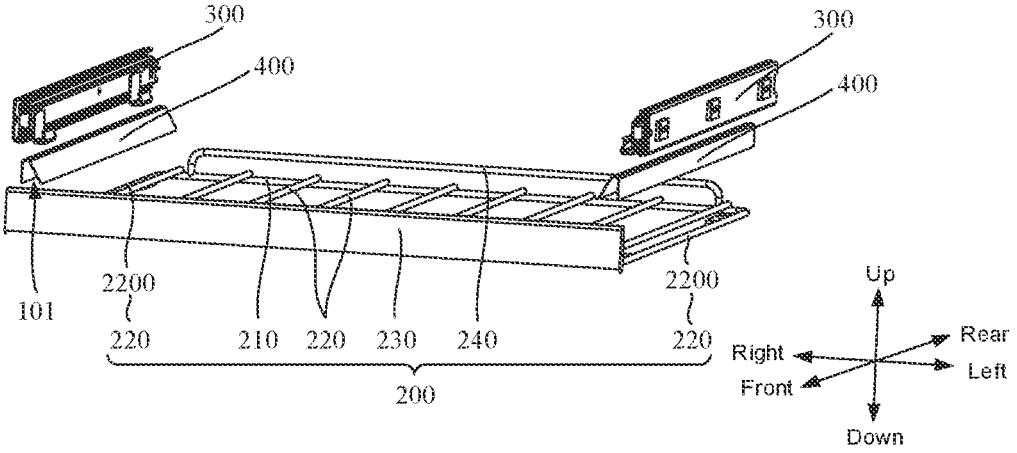
FIG. 4 is an exploded view of FIG. 3.
Figure 5:
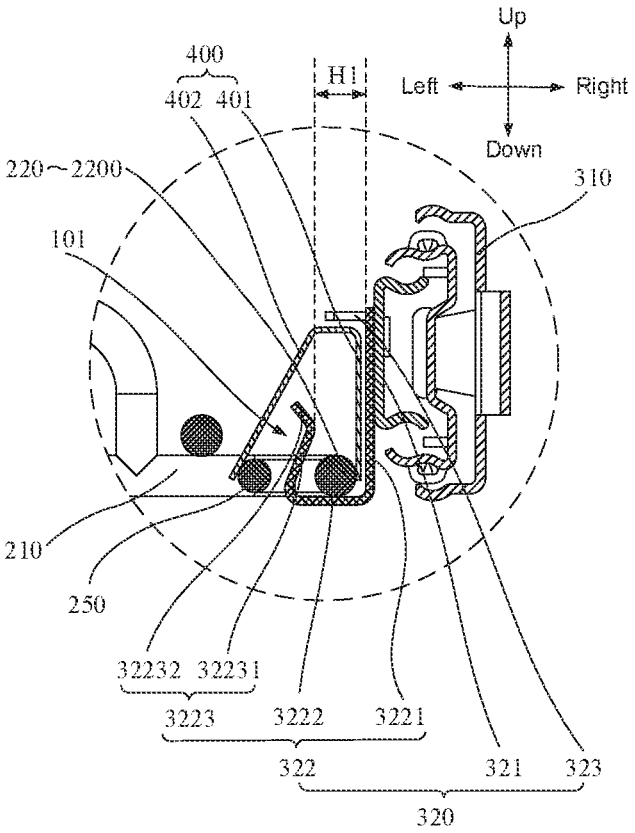
FIG. 5 is a partial sectional view of FIG. 3.

FIG. 1 is a diagram showing a structure of a wine cabinet, in accordance with some embodiments. FIG. 2 is a diagram showing a structure of a cabinet body in a wine cabinet, in accordance with some embodiments. FIG. 3 is a diagram showing a structure of a shelf, a slide rail, and a protective cover in a wine cabinet, in accordance with some embodiments. FIG. 4 is an exploded view of FIG. 3. FIG. 5 is a partial sectional view of FIG. 3.

As shown in FIGS. 1 and 2, the wine cabinet 1 includes a cabinet body 100, a cabinet door 110, a shelf 200, a slide rail 300, and a protective cover 400.

The cabinet body 100 is provided with a storage compartment 120, and a side (e.g., the front side) of the cabinet body 100 proximate to the cabinet door 110 is open, so as to form a fourth opening 104. The cabinet door 110 is disposed on the cabinet body 100 and is located at the fourth opening 104. The cabinet door 110 is configured to open or close the storage compartment 120.

The shelf 200 and the slide rail 300 are disposed in the storage compartment 120, and the shelf 200 is detachably connected with the slide rail 300. For example, as shown in FIGS. 3 to 5, the shelf 200 is clamped with the slide rail 300. The slide rail 300 extends in a width direction (e.g., the front-rear direction) of the cabinet body 100, and is connected with the cabinet body 100. The shelf 200 is connected with the cabinet body 100 through the slide rail 300, and the shelf 200 is slidably disposed on the slide rail 300. For example, the shelf 200 slides in an extending direction (e.g., the front-rear direction) of the slide rail 300. In this way, the shelf 200 may be pulled out from the front side of the cabinet body 100, and may be pushed into a side (e.g., the rear side) of the cabinet body 100 away from the cabinet door 110, so that a wine bottle on the shelf 200 may be taken and placed easily.

The protective cover 400 is located between the slide rail 300 and the shelf 200, and is detachably disposed at a connecting position between the shelf 200 and the slide rail 300, so as to prevent the wine bottle on the shelf 200 from being scratched. For example, the protective cover 400 covers at the connecting position between the shelf 200 and the slide rail 300.

In some embodiments, the wine cabinet 1 may include one shelf 200 and one slide rail 300 or two slide rails 300. In some other embodiments, the wine cabinet 1 may also include a plurality of shelves 200 and a plurality of slide rails 300. In a case where the wine cabinet 1 includes the plurality of shelves 200 and the plurality of slide rails 300, the plurality of shelves 200 are arranged at intervals in a height direction (e.g., the up-down direction) of the cabinet body 100, and each shelf 200 is detachably connected with at least two slide rails 300. For example, the wine cabinet 1 includes two shelves 200 and four slide rails 300, and each shelf 200 is clamped with two slide rails 300. Moreover, the two slide rails 300 are respectively located on two sides (e.g., the left side and the right side of the shelf 200) of the shelf 200 in a length direction (e.g., the left-right direction) of the cabinet body 100.

Figure 6:
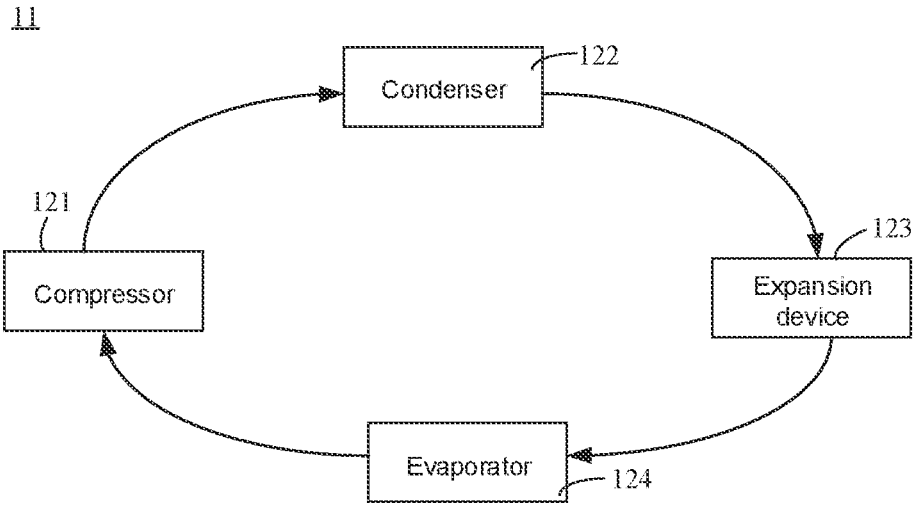
FIG. 6 is a schematic diagram of a cold air supply device, in accordance with some embodiments.

FIG. 6 is a schematic diagram of a cold air supply device, in accordance with some embodiments.

In some embodiments, as shown in FIG. 6, the wine cabinet 1 further includes a cold air supply device 11. The cold air supply device 11 is disposed in the cabinet body 100, and is configured to cool the storage compartment 120, so that the temperature in the storage compartment 120 may reach a preset storage temperature, so as to ensure the quality of the wine.

The cold air supply device 11 cools the storage compartment 120 by exchanging heat with the outside of the cabinet body 100. For example, as shown in FIG. 6, the cold air supply device 11 includes a compressor 121, a condenser 122, an expansion device 123, and an evaporator 124, and refrigerant circulates in an order of the compressor 121, the condenser 122, the expansion device 123, the evaporator 124, and the compressor 121 to cool the storage compartment 120.

For example, the evaporator 124 may be arranged to be in contact with an outer wall of the storage compartment 120, so as to directly cool the storage compartment 120. In some embodiments, the cold air supply device 11 may further include a circulation fan, so that air in the storage compartment 120 may be cooled through the evaporator 124 or circulated through the circulation fan.

Figure 7:
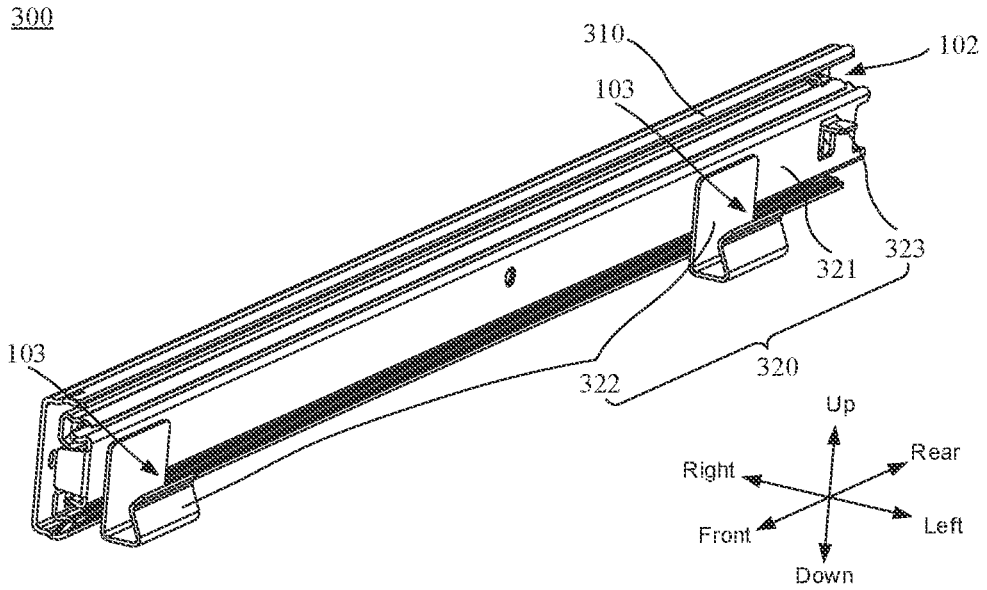
FIG. 7 is a diagram showing a structure of a slide rail in a wine cabinet, in accordance with some embodiments.

FIG. 7 is a diagram showing a structure of a slide rail in a wine cabinet, in accordance with some embodiments.

In some embodiments, as shown in FIG. 7, the slide rail 300 includes a first slide sub-rail 310 and a second slide sub-rail 320. The first slide sub-rail 310 is fixedly disposed on an inner side wall of the cabinet body 100. The second slide sub-rail 320 is connected with the first slide sub-rail 310 and is disposed on a side of the first slide sub-rail 310 away from the inner side wall of the cabinet body 100, and the second slide sub-rail 320 is slidable with respect to the first slide sub-rail 310. For example, the second slide sub-rail 320 may slide in the front-rear direction with respect to the first slide sub-rail 310. The shelf 200 is detachably connected with the second slide sub-rail 320. In this way, the shelf 200 may slide forth and back with the second slide sub-rail 320, so that the shelf 200 may be accommodated in the storage compartment 120 or pulled out from the storage compartment 120.

For example, a side of the first slide sub-rail 310 away from the inner side wall of the cabinet body 100 is open, so as to form a second opening 102. A portion of the second slide sub-rail 320 is connected with (e.g., clamped with) the first slide sub-rail 310 through the second opening 102. Another portion of the second slide sub-rail 320 is located outside the first slide sub-rail 310. In this way, a position of the second slide sub-rail 320 may be limited by the first slide sub-rail 310, so as to prevent the second slide sub-rail 320 from being turned over with respect to the first slide sub-rail 310, thereby preventing the shelf 200 from being turned over.

Of course, in some embodiments, the second opening 102 may also be located at other positions of the first slide sub-rail 310. For example, at least one of a portion (e.g., the upper portion or the lower portion) of the first slide sub-rail 310 away from or proximate to the bottom of the cabinet body 100 is open, so as to form the second opening 102. In this case, at least one of a portion (e.g., the upper portion or the lower portion) of the second slide sub-rail 320 away from or proximate to the bottom of the cabinet body 100 is disposed in the second opening 102.

Figure 8:
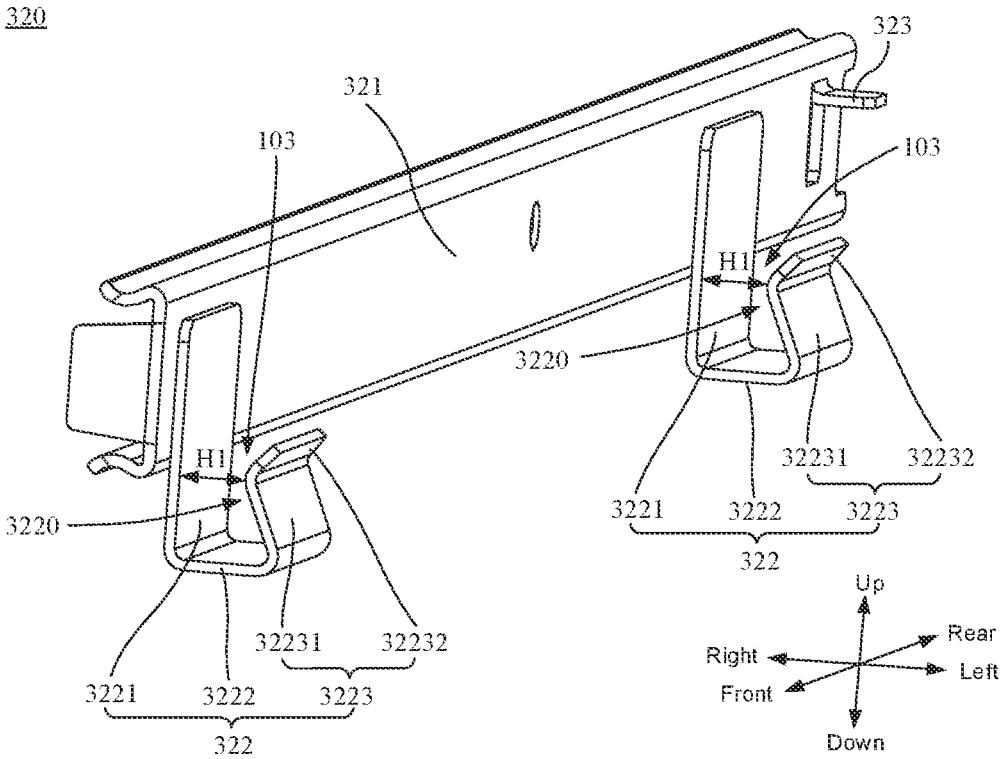
FIG. 8 is a structural diagram of a second slide sub-rail in a slide rail, in accordance with some embodiments.

FIG. 8 is a diagram showing a structure of a second slide sub-rail in a slide rail, in accordance with some embodiments.

In some embodiments, as shown in FIGS. 7 and 8, the second slide sub-rail 320 includes a main body 321 and a fixing member 322.

A portion of the main body 321 is located in the first slide sub-rail 310, and is connected (e.g., clamped) with the first slide sub-rail 310, and another portion of the main body 321 is located outside the first slide sub-rail 310. The main body 321 is slidable with respect to the first slide sub-rail 310.

The fixing member 322 is fixedly disposed on the main body 321 and is located outside the first slide sub-rail 310. For example, the fixing member 322 is disposed on a side of the main body 321 proximate to the shelf 200. Moreover, a side (e.g., the upper side) of the fixing member 322 away from the bottom of the cabinet body 100 is open, so as to form a third opening 103, which is convenient for the shelf 200 to be detachably connected (e.g., clamped) with the fixing member 322.

In some embodiments, the main body 321 extends in the width direction of the cabinet body 100. The second slide sub-rail 320 may include a plurality of fixing members 322, and the plurality of fixing members 322 are arranged at intervals in an extending direction (e.g., the front-rear direction) of the main body 321. For example, as shown in FIG. 8, the second slide sub-rail 320 includes two fixing members 322, and the two fixing members 322 are arranged at an interval in the front-rear direction. Of course, the second slide sub-rail 320 may also include one, three, four, or more fixing members 322, the present disclosure is not limited thereto.

In some embodiments, as shown in FIG. 8, the fixing member 322 includes a fixing portion 3221, a connecting portion 3222 and an elastic portion 3223. The fixing portion 3221 is fixedly connected with the main body 321. An end of the connecting portion 3222 is connected with the fixing portion 3221, and another end of the connecting portion 3222 is connected with the elastic portion 3223. The connecting portion 3222 extends from an end (e.g., the lower end) of the fixing portion 3221 proximate to the bottom of the cabinet body 100 in a direction away from the main body 321. The elastic portion 3223 extends (e.g., upward) from an end of the connecting portion 3222 away from the fixing portion 3221 in a direction away from the bottom of the cabinet body 100. That is, the fixing portion 3221 and the elastic portion 3223 are located on a same side of the connecting portion 3222 in a thickness direction.

The fixing member 322 further includes an installation space 3220, and the fixing portion 3221, the connecting portion 3222, and the elastic portion 3223 define the installation space 3220 together. The third opening 103 is located on a side of the installation space 3220 away from the connecting portion 3222. At least a portion of the shelf 200 is disposed in the installation space 3220, and is supported by the connecting portion 3222. For example, at least a portion of the shelf 200 is clamped into the installation space 3220.

In some embodiments, as shown in FIG. 8, the fixing portion 3221 extends in the height direction of the cabinet body 100, and the connecting portion 3222 extends in the length direction of the cabinet body 100, and the fixing portion 3221 is perpendicular to the connecting portion 3222. For example, the fixing portion 3221 extends in the vertical direction, and the connecting portion 3222 extends in the horizontal direction. In addition, the elastic portion 3223 includes a first elastic sub-portion 32231 and a second elastic sub-portion 32232. The first elastic sub-portion 32231 is closer to the connecting portion 3222 than the second elastic sub-portion 32232. For example, an end of the first elastic sub-portion 32231 is connected with the connecting portion 3222, and another end of the first elastic sub-portion 32231 is connected with the second elastic sub-portion 32232.

The first elastic sub-portion 32231 extends (e.g., upward) in the direction away from the bottom of the cabinet body 100, and is inclined in a direction proximate to the fixing portion 3221. The second elastic sub-portion 32232 extends (e.g., upward) in the direction away from the bottom of the cabinet body 100, and is inclined in a direction away from the fixing portion 3221. In this way, the third opening 103 may be rather large, which facilitates alignment between the shelf 200 and the fixing member 322 when they are connected with each other, saves installation time, and improves installation efficiency. Moreover, a gap (the distance H1 as shown in FIGS. 5 and 8) between a connecting position between the first elastic sub-portion 32231 and the second elastic sub-portion 32232 (e.g., the middle portion of the elastic portion 3223) and the fixing portion 3221 is small, so as to prevent the shelf 200 from being disengaged from the fixing member 322.

In some embodiments, as shown in FIGS. 7 and 8, the second slide sub-rail 320 further includes a protrusion 323. The protrusion 323 is fixedly disposed on the main body 321 and is located outside the first slide sub-rail 310. For example, the protrusion 323 is disposed on the side of the main body 321 proximate to the shelf 200. The protrusion 323 protrudes in a direction proximate to the shelf 200, and the protrusion 323 may abut against an end of the protective cover 400 away from the bottom of the cabinet body 100 (e.g., the upper end), so as to limit the protective cover 400. In this way, it may be possible to prevent the protective cover 400 from moving in the direction away from the bottom of the cabinet body 100 (e.g., from the bottom to the top), so as to prevent the protective cover 400 from being disengaged from the fixing member 322, thereby preventing the shelf 200 from being disengaged from the fixing member 322 and preventing the shelf 200 from being turned over.

In some embodiments, as shown in FIGS. 5, 7 and 8, the protrusion 323 is disposed on a side (e.g., the rear side) of the fixing member 322, farthest away from the cabinet door 110 in the plurality of fixing members 322, away from the cabinet door 110, which is convenient for the protective cover 400 to extend into the fixing member 322 and be located under the protrusion 323 after the shelf 200 is clamped with the installation space 3220. For example, after the shelf 200 is clamped with the fixing member 322, the protective cover 400 extends obliquely into the installation space 3220 in the front-rear direction of the cabinet body 100, then the protective cover 400 is pressed downward, so that the protective cover 400 is connected with the second slide sub-rail 320, thereby achieving a quick installation of the protective cover 400.

Figure 9:
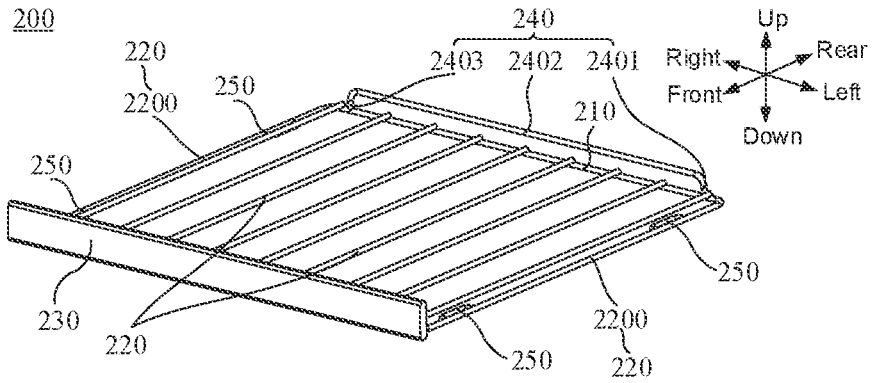
FIG. 9 is a diagram showing a structure of a shelf, in accordance with some embodiments.
Figure 10:
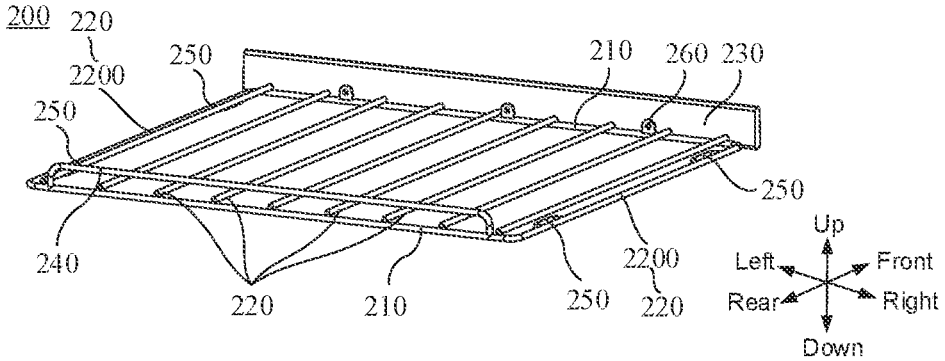
FIG. 10 is a diagram showing a structure of a shelf from another perspective, in accordance with some embodiments.

FIG. 9 is a diagram showing a structure of a shelf, in accordance with some embodiments. FIG. 10 is a diagram showing a structure of a shelf from another perspective, in accordance with some embodiments.

In some embodiments, as shown in FIGS. 9 and 10, the shelf 200 includes two first connecting rods 210, a plurality of second connecting rods 220, a baffle 230, and a blocking member 240.

The two first connecting rods 210 are arranged at an interval in the front-rear direction, and the two first connecting rods 210 each extend in the length direction of the cabinet body 100. The plurality of second connecting rods 220 are arranged at intervals in the length direction of the cabinet body 100, and the plurality of second connecting rods 220 each are connected with the two first connecting rods 210. Each of the plurality of the second connecting rods 220 is perpendicular to the two first connecting rods 210, so that the second connecting rod 220 may extend in the front-rear direction of the cabinet body 100. The baffle 230 is fixedly connected with one of the two first connecting rods 210 (i.e., the first connecting rod 210 proximate to the front side of the cabinet body 100) proximate to the cabinet door 110, and the baffle 230 may be made of a wood material. The blocking member 240 is disposed on another one of the first connecting rods 210 (i.e., the first connecting rod 210 proximate to the rear side of the cabinet body 100) away from the cabinet door 110. For example, as shown in FIG. 9, the blocking member 240 includes a first segment 2401, a second segment 2402 and a third segment 2403 connected in sequence. The first segment 2401 is connected to the first connecting rod 210 and extends in a direction away from the bottom of the cabinet body 100. The second segment 2402 is connected to the first segment 2401 and is located above the first connecting rod 210 and extends in the same direction as the first connecting rod 210. The third segment 2403 is connected to the second segment 2402 and the first connecting rod 210 respectively and extends in a direction proximate to the bottom of the cabinet body 100.

As shown in FIGS. 9 and 10, in the plurality of second connecting rods 220, two second connecting rods 220 located on the outermost side form two fixing rods 2200 of the shelf 200. That is to say, in the plurality of second connecting rods 220, the second connecting rods 220 located on the left side and the right side of the shelf 200 form the fixing rods 2200. The fixing rod 2200 is connected with (e.g., clamped with) the corresponding fixing member 322. In this way, the two fixing rods 2200 on the left side and the right side of the shelf 200 may be respectively clamped with the fixing members 322 located on the left side and the right side of the shelf 200, so as to limit the movement of the shelf 200 in the length direction of the cabinet body 100.

It will be noted that, in some embodiments of the present disclosure, the description will be made by taking an example in which the shelf 200 includes two first connecting rods 210. Of course, in some embodiments, the shelf 200 may also include one, three, or more first connecting rods 210, the present disclosure is not limited thereto.

In some embodiments, the first connecting rod 210 and the second connecting rod 220 may be made of a steel wire. Compared with the first connecting rod 210 and the second connecting rod 220 that are made of wood, by providing the first connecting rod 210 and the second connecting rod 220 that are made of steel wire, it may be possible to reduce the production cost.

In some embodiments, an outer circumference of the second connecting rod 220 may be in a shape of a circle. In this way, in a case where a wine bottle is placed on the shelf 200, the wine bottle may be limited between two second connecting rods 220. Moreover, in a case where the circular outer circumference of the wine bottle matches with the circular outer circumference of the second connecting rod 220, it may be possible to reduce the shake of the wine bottle.

In some embodiments, a shape of a cross section of the fixing rod 2200 matches with a shape of the elastic portion 3223. For example, in a case where the outer circumference of the second connecting rod 220 is in a shape of a circle, the elastic portion 3223 may be in a shape of a circular arc, so that the circular outer circumference of the fixing rod 2200 may match with the shape of the elastic portion 3223, which is convenient for the fixing rod 2200 to be clamped with the fixing member 322. It will be noted that, the cross section of the fixing rod 2200 may be perpendicular to a central axis of the fixing rod 2200.

Of course, in some embodiments, the shelf 200 may not be provided with the first connecting rod 210 and the second connecting rod 220, and only the corresponding fixing rods 2200 are disposed on the left side and the right side of the shelf 200, so as to achieve a connection between the fixing rod 2200 and the fixing member 322.

Figure 11:
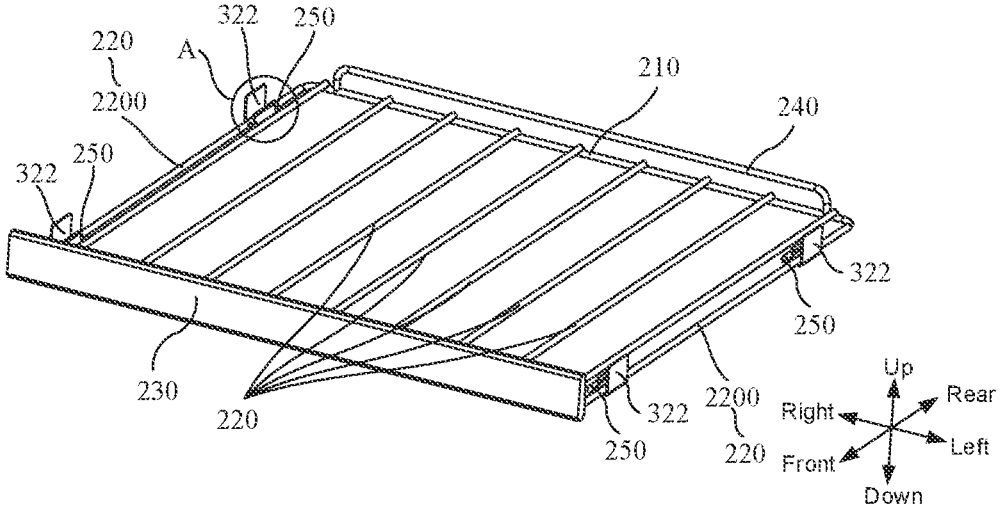
FIG. 11 is a diagram showing a structure of a shelf and a fixing member in a case where the shelf is connected with the fixing member, in accordance with some embodiments.

FIG. 11 is a diagram showing a structure of a shelf and a fixing member in a case where the shelf is connected with the fixing member, in accordance with some embodiments.

In some embodiments, as shown in FIGS. 9 to 11, in the height direction of the cabinet body 100, a height of the first connecting rod 210, and a height of the second connecting rod 220 each are less than a height of the baffle 230, and the height of the first connecting rod 210 and the height of the second connecting rod 220 each are less than a height of the blocking member 240. In this way, in a case where the wine bottle is placed on the shelf 200 in the width direction of the cabinet body 100, the baffle 230 and the blocking member 240 may limit the front end and the rear end of the wine bottle, respectively, thereby preventing the wine bottle from falling off the shelf 200 as the wine bottle moves forth and back. Moreover, the baffle 230 may also serve as a handle, which facilitates pushing and pulling the shelf 200.

Figure 12:
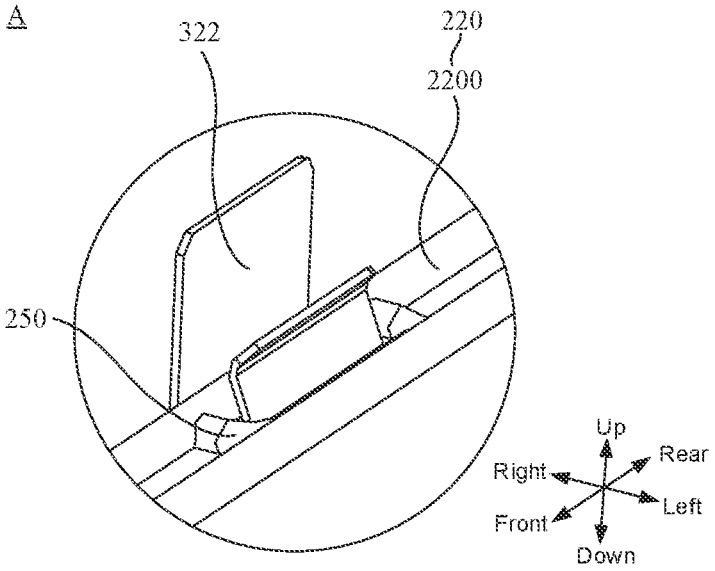
FIG. 12 is a partial enlarged view of the circle A in FIG. 11, in accordance with some embodiments.

FIG. 12 is a partial enlarged view of the circle A in FIG. 11, in accordance with some embodiments.

In some embodiments, as shown in FIGS. 9 to 11, the shelf 200 further includes a connecting member 250. The connecting member 250 is disposed on the fixing rod 2200, and the connecting member 250 is configured to limit the shelf 200 from moving forth and back with respect to the second slide sub-rail 320. For example, as shown in FIG. 12, the connecting member 250 abuts against a front side of the fixing member 322 and a rear side of fixing member 322.

FIGS. 9 to 11 show an example in which the shelf 200 includes four connecting members 250, and each fixing rod 2200 is provided with two connecting members 250. Of course, the shelf 200 may also include one, two, three, or more connecting members 250, the present disclosure is not limited thereto.

In some embodiments, as shown in FIG. 10, the shelf 200 further includes a fixing ring 260. The fixing ring 260 is located on the first connecting rod 210 proximate to the cabinet door 110. The fixing ring 260 is configured to connect the baffle 230 with a corresponding first connecting rod 210. For example, the fixing ring 260 is welded to the first connecting rod 210 proximate to the cabinet door 110, and the fixing ring 260 is connected to the baffle 230 by means of a bolt or a screw. In some embodiments, the shelf 200 may also include a plurality of fixing rings 260.

In some embodiments, as shown in FIGS. 3 to 5, a side of the protective cover 400 proximate to the bottom of the cabinet body 100 is open, so as to form a first opening 101. The protective cover 400 is detachably disposed on a side of the fixing rod 2200 away from the bottom of the cabinet body 100. For example, the lower side of the protective cover 400 is open, so as to form the first opening 101. The protective cover 400 is clamped with the upper side of the fixing rod 2200.

In some embodiments, as shown in FIG. 5, a first portion of the protective cover 400 is disposed in the installation space 3220, and a second portion of the protective cover 400 is disposed on a side of the fixing member 322 away from the main body 321.

For example, the first portion of the protective cover 400 is disposed between the fixing portion 3221 and the corresponding fixing rod 2200, and the second portion of the protective cover 400 is disposed on a side of the elastic portion 3223 away from the fixing rod 2200 and is located on a side (e.g., the upper side) of the elastic portion 3223 away from the bottom of the cabinet body 100. Moreover, the first portion of the protective cover 400 abuts against a portion (e.g., the fixing rod 2200) of the shelf 200 located in the installation space 3220. In this way, the protective cover 400 may press the fixing rod 2200 in a direction proximate to the elastic portion 3223. In this case, since the gap (e.g., the distance H1) between the middle portion of the elastic portion 3223 and the fixing portion 3221 is small, the position of the fixing rod 2200 may be limited on a side of the installation space 3220 proximate to the bottom of the cabinet body 100, so as to prevent the fixing rod 2200 from being disengaged from the fixing member 322, and thereby preventing the shelf 200 from being turned over.

The second portion of the protective cover 400 extends (e.g., downward) in a direction proximate to the bottom of the cabinet body 100, and is inclined in a direction away from the slide rail 300. Moreover, by providing the second portion of the protective cover 400 located on the side of the elastic portion 3223 away from the fixing rod 2200, at least a part of the fixing member 322 may be covered by the protective cover 400, thereby preventing the wine bottle on the shelf 200 from being scratched by the fixing member 322. In addition, by providing the protective cover 400 to cover at least the part of the fixing member 322, it is also possible to make a smooth transition at the connecting position between the shelf 200 and the slide rail 300, thereby improving the aesthetics of the connection between the shelf 200 and the slide rail 300.

For example, as shown in FIG. 5, the protective cover 400 includes a first plate body 401 and a second plate body 402. The first plate body 401 is connected with the second plate body 402, and the second plate body 402 is inclined with respect to the first plate body 401. The first plate body 401 extends in the height direction of the cabinet body 100, and an end (e.g., the lower end) of the first plate body 401 proximate to the bottom of the cabinet body 100 extends into the installation space 3220. Moreover, the first plate body 401 is located between the fixing rod 2200 and the fixing portion 3221, and the first plate body 401 abuts against the fixing rod 2200. The second plate body 402 extends (e.g., downward) in the direction proximate to the bottom of the cabinet body 100 and is inclined in the direction away from the slide rail 300. An end (e.g., the lower end) of the second plate body 402 proximate to the bottom of the cabinet body 100 is located on the shelf 200, and is disposed on the side of the elastic portion 3223 away from the fixing rod 2200. It will be noted that, in some embodiments, the connecting position between the first plate body 401 and the second plate body 402 may be parallel to a protruding direction of the protrusion 323. For example, as shown in FIG. 5, the connecting position between the first plate body 401 and the second plate body 402 and the protrusion 323 are parallel to the length direction of the cabinet body 100.

Since the extending direction of the first plate body 401 is the same as the extending direction of the fixing portion 3221, the first plate body 401 and the fixing portion 3221 are arranged in parallel, which is convenient for the protective cover 400 to be quickly inserted into the installation space 3220. Moreover, by providing the second plate body 402 obliquely, the impact force of the wine bottle may be buffered by the protective cover 400 when the wine bottle moves in the left-right direction of the cabinet body 100 and collides with the second plate body 402, so as to avoid the breakage of the wine bottle.

In some embodiments of the present disclosure, by providing the detachable shelf 200, it may be possible to separate the shelf 200 from the cabinet body 100 during the transportation of the wine cabinet 1, and there is no need to consider the fixing between the shelf 200 and the cabinet body 100, so as to avoid a situation that the wine cabinet 1 is broken due to the collision between the shelf 200 and the cabinet body 100 and prevent the shelf 200 from falling off. In addition, after the transportation of the wine cabinet 1 is completed, it may be possible to quickly install the shelf 200 in the cabinet body 100, thereby facilitating the installation of the wine cabinet 1. Moreover, by providing the protective cover 400 to cover the connecting position between the shelf 200 and the slide rail 300, it may be possible to avoid the collision between the wine bottle and the slide rail 300 and also improve the reliability of the connection between the shelf 200 and the slide rail 300.

A person skilled in the art will understand that, the scope of disclosure in the present disclosure is not limited to specific embodiments discussed above, and may modify and substitute some elements of the embodiments without departing from the spirits of this application. The scope of the application is limited by the appended claims.

What is claimed is:

1. A wine cabinet, comprising:

a cabinet body provided with a storage compartment;

a cabinet door disposed on the cabinet body and configured to open or close the storage compartment;

at least one slide rail disposed in the storage compartment, and each slide rail including:

a first slide sub-rail disposed on the cabinet body; and a second slide sub-rail being slidable with respect to the first slide sub-rail, and the second slide sub-rail including:

a main body; and at least one fixing member disposed on the main body, and each fixing member including an installation space;

at least one shelf, each shelf being detachably connected with the fixing member, so as to slide along with the second slide sub-rail; and a protective cover being detachably disposed at a connecting position between the shelf and the slide rail;

wherein a first portion of the protective cover is disposed in the installation space and abuts against a portion of the shelf located in the installation space, a second portion of the protective cover is disposed on a side of the fixing member away from the main body, and the second portion of the protective cover extends in a direction proximate to a bottom of the cabinet body and is inclined in a direction away from the slide rail;

wherein fixing rods are disposed on two sides of the shelf in a length direction of the cabinet body, and each fixing rod of the fixing rods is detachably connected with the fixing member; and the fixing member further includes:

a fixing portion connected with the main body;

a connecting portion connected with the fixing portion and extending in a direction away from the main body; and an elastic portion connected with the connecting portion and extending in a direction away from the bottom of the cabinet body, the fixing portion and the elastic portion being located on a same side of the connecting portion in a thickness direction, wherein the fixing portion, the connecting portion and the elastic portion define the installation space, at least a portion of the shelf is disposed in the installation space and being supported by the connecting portion;

the first portion of the protective cover is located between a corresponding fixing rod of the fixing rods and the fixing portion, and abuts against the corresponding fixing rod, so as to press the corresponding fixing rod in a direction proximate to the elastic portion; and the second portion of the protective cover is disposed on a side of the elastic portion away from the fixing portion and is located on a side of the elastic portion away from the bottom of the cabinet body.

2. The wine cabinet according to claim 1, wherein the elastic portion includes:

a first elastic sub-portion connected with the connecting portion, the first elastic sub-portion extending in the direction away from the bottom of the cabinet body and being inclined in a direction proximate to the fixing portion; and a second elastic sub-portion connected with the first elastic sub-portion, the second elastic sub-portion extending in the direction away from the bottom of the cabinet body and being inclined in a direction away from the fixing portion.

3. The wine cabinet according to claim 1, wherein a side of the protective cover proximate to the bottom of the cabinet body is open, so as to provide a first opening, and the protective cover includes:

a first plate body located between the fixing portion and the corresponding fixing rod and abutting against the corresponding fixing rod; and a second plate body connected with the first plate body and disposed on a side of the elastic portion away from the corresponding fixing rod, the second plate body extending in the direction proximate to the bottom of the cabinet body and being inclined in the direction away from the slide rail.

4. The wine cabinet according to claim 1, wherein the shelf includes at least one connecting member, each connecting member being disposed on the corresponding fixing rod, and the connecting member abutting against a side of the fixing member proximate to the cabinet door and a side of the fixing member away from the cabinet door.

5. The wine cabinet according to claim 4, wherein the at least one connecting member includes a plurality of connecting members, and the plurality of connecting members each are disposed on the corresponding fixing rod.

6. The wine cabinet according to claim 1, wherein the shelf includes:

two first connecting rods arranged at an interval in a width direction of the cabinet body and extending in the length direction of the cabinet body;

a plurality of second connecting rods, the plurality of second connecting rods each being connected between the two first connecting rods, and the plurality of second connecting rods being arranged at intervals, the plurality of second connecting rods each being arranged perpendicular to the two first connecting rods, and two of the plurality of second connecting rods located on an outermost side constituting two fixing rods;

a baffle connected with one first connecting rod of the two first connecting rods proximate to the cabinet door; and a blocking member disposed on another one first connecting rod of the two first connecting rods away from the cabinet door.

7. The wine cabinet according to claim 6, wherein in a height direction of the cabinet body, a height of each first connecting rod and a height of each second connecting rod each are less than a height of the baffle, and the height of the first connecting rod and the height of the second connecting rod each are less than a height of the blocking member.

8. The wine cabinet according to claim 6, wherein the shelf further includes a fixing ring, the fixing ring is disposed on the one first connecting rod proximate to the cabinet door, and the baffle is detachably connected with the fixing ring.

9. The wine cabinet according to claim 1, wherein a shape of a cross section of the corresponding fixing rod matches with a shape of the elastic portion.

10. The wine cabinet according to claim 1, wherein the fixing rod is clamped with the fixing member.

11. The wine cabinet according to claim 1, wherein the main body is slidable with respect to the first slide sub-rail; and wherein a side of the first slide sub-rail away from an inner side wall of the cabinet body is open, so as to provide a second opening, a portion of the main body is located in the first slide sub-rail and is connected with the first slide sub-rail, and another portion of the main body and the fixing member are located outside the first slide sub-rail.

12. The wine cabinet according to claim 1, wherein at least one of a portion of the first slide sub-rail away from or proximate to the bottom of the cabinet body is open, so as to provide a second opening, and at least one of a portion of the second slide sub-rail away from or proximate to the bottom of the cabinet body is disposed in the second opening.

13. The wine cabinet according to claim 1, wherein the main body extends in a width direction of the cabinet body, the fixing member is disposed on a side of the main body proximate to the shelf, and a side of the fixing member away from the bottom of the cabinet body is open, so as to provide a third opening.

14. The wine cabinet according to claim 13, wherein the at least one fixing member includes a plurality of fixing members, and the plurality of fixing members are arranged at intervals in an extending direction of the main body.

15. The wine cabinet according to claim 1, wherein the second slide sub-rail further includes a protrusion, the protrusion is disposed on a side of the main body proximate to the shelf, and protrudes in a direction proximate to the shelf, so as to limit the protective cover.

16. The wine cabinet according to claim 15, wherein the at least one fixing member includes a plurality of fixing members, and the protrusion is disposed on a side of a fixing member, farthest away from the cabinet door in the plurality of fixing members, away from the cabinet door.

17. The wine cabinet according to claim 1, wherein the at least one slide rail includes a plurality of slide rails, the at least one shelf includes a plurality of shelves, the plurality of shelves are arranged at intervals in a height direction of the cabinet body, and one or more shelves are detachably connected with two or more slide rails.

18. The wine cabinet according to claim 17, wherein two slide rails are disposed on two sides of any shelf of the plurality of shelves in a length direction of the cabinet body, and the any shelf is connected with fixing members of the two slide rails, so as to limit movement of the any shelf in the length direction of the cabinet body.

* * * * *